US010224161B2

(12) United States Patent
Hemmer et al.

(10) Patent No.: US 10,224,161 B2
(45) Date of Patent: Mar. 5, 2019

(54) APPARATUS FOR OPERATING A ROTARY SWITCH

(71) Applicant: Eaton Electrical IP GmbH & Co. KG, Schoenefeld (DE)

(72) Inventors: Louis A. G. M. Hemmer, Hengelo (NL); Hans-Juergen Sduntzig, Koenigswinter (DE)

(73) Assignee: EATON INTELLIGENT POWER LIMITED, Dublin (IE)

( * ) Notice: Subject to any disclaimer, the term of this patent is extended or adjusted under 35 U.S.C. 154(b) by 3 days.

(21) Appl. No.: 15/525,295

(22) PCT Filed: Nov. 6, 2015

(86) PCT No.: PCT/EP2015/075893
§ 371 (c)(1),
(2) Date: May 9, 2017

(87) PCT Pub. No.: WO2016/075038
PCT Pub. Date: May 19, 2016

(65) Prior Publication Data

US 2017/0316902 A1 Nov. 2, 2017

(30) Foreign Application Priority Data

Nov. 11, 2014 (DE) ..... 10 2014 116 398

(51) Int. Cl.
*H01H 19/14* (2006.01)
*H01H 19/24* (2006.01)
(Continued)

(52) U.S. Cl.
CPC ..... *H01H 19/14* (2013.01); *H01H 19/20* (2013.01); *H01H 19/24* (2013.01); *H01H 5/16* (2013.01);
(Continued)

(58) Field of Classification Search
CPC ..... Y10T 74/19874; Y10T 74/19642; Y10T 74/19647; H01H 3/3021; H01H 2003/3063; H01H 2043/107; H01H 3/30
(Continued)

(56) References Cited

U.S. PATENT DOCUMENTS 2,137,111 A * 11/1938 Hale et al. ..... G07F 17/0007 116/303
3,402,693 A * 9/1968 Tweed ..... G06M 1/02 116/295
(Continued)

FOREIGN PATENT DOCUMENTS

CN 101826411 A 9/2010
CN 102047362 A 5/2011
(Continued)

*Primary Examiner* — Ahmed Saeed
(74) *Attorney, Agent, or Firm* — Leydig, Voit & Mayer, Ltd.

(57) ABSTRACT

A rotary switch operating apparatus has a drive shaft and a first and a second drive element, the first drive element having a rotationally fixed coupling to the drive shaft, and the second drive element being rotatably mounted on the first drive element. The apparatus includes a spring coupling the first and the second drive element together with a spring action, a lock limiting rotational movements of the second drive element in a first rotation direction and a second rotation direction, opposite the first, and a releaser for canceling rotational movement limitation of the second drive element in pre-specified rotation positions of the first drive element. Latches bearing against the drive elements' guide sections are provided, the first drive element guide section having release sections as releasers and the second drive element guide section having two latch stops as locks.

7 Claims, 8 Drawing Sheets

(51) Int. Cl.
*H01H 19/20* (2006.01)
*H01H 5/16* (2006.01)

(52) U.S. Cl.
CPC ..... *H01H 2221/08* (2013.01); *H01H 2235/01* (2013.01)

(58) Field of Classification Search
USPC ..... 200/335, 400, 501; 74/412 R, 413, 435
See application file for complete search history.

(56) References Cited

U.S. PATENT DOCUMENTS

| | | | | |
|---|---|---|---|---|
| 4,996,397 | A * | 2/1991 | Kuhn | H01H 3/3042 200/568 |
| 7,467,759 | B2 * | 12/2008 | Brown | B65H 59/16 242/419.1 |
| 2004/0003989 | A1 * | 1/2004 | Allmen | H01H 3/3005 200/400 |
| 2011/0073453 | A1 | 3/2011 | Boettcher et al. | |
| 2011/0226074 | A1 * | 9/2011 | Engemann | H01H 3/3021 74/54 |
| 2012/0298494 | A1 | 11/2012 | Mahida et al. | |
| 2015/0033808 | A1 * | 2/2015 | Taylor | E05B 47/0603 70/101 |

FOREIGN PATENT DOCUMENTS

| | | | |
|---|---|---|---|
| CN | 102468077 | A | 5/2012 |
| DE | 1720869 | U | 4/1956 |
| DE | 3100602 | A1 | 1/1982 |
| DE | 3518419 | C2 | 8/1988 |
| FR | 2533067 | A1 | 3/1984 |

* cited by examiner

APPARATUS FOR OPERATING A ROTARY SWITCH

CROSS-REFERENCE TO RELATED APPLICATIONS

This application is a U.S. national stage application under 35 U.S.C. § 371 of International Application No. PCT/EP2015/075893, filed on Nov. 6, 2015, and claims benefit to German Patent Application No. DE 10 2014 116 398.2, filed on Nov. 11, 2014. The International Application was published in German on May 19, 2016, as WO 2016/075038 A1 under PCT Article 21(2).

FIELD

The invention relates to an apparatus for operating a rotary switch.

BACKGROUND

When using rotary switches, a variety of parameters such as electrical durability, the force required to operate the switch, and contact opening and closing speeds are often directly dependent on the speed and force with which the rotary switch is operated. A variety of apparatuses for operating rotary switches are known in the art, for example from German utility model document DE 17 20 869 U, German patent specification DE 35 18 419 C2 and French patent application FR 2 533 067 A1.

German patent application DE 31 00 602 A1 describes a rotary switch operating apparatus having the same features as the preamble of claim 1. An inhibiting part comprising recesses in which pins engage is provided as a locking means to limit a rotational movement of a second drive element of the operating apparatus. A control cam for the pins, said cam extending in a circular arc, acts as a release means to cancel limiting of the rotational movement, said cam being provided in the coupling half on the drive side of the operating apparatus, said coupling half acting as the first drive element.

SUMMARY

An aspect of the invention provides an apparatus for operating a rotary switch, the apparatus comprising: a drive shaft; a first drive element, coupled to the drive shaft in a rotationally fixed manner; a second drive element, mounted on the first drive element in a rotatable manner; a spring which couples the first and the second drive element together in a resilient manner; a lock, configured to limit one or more rotational movements of the second drive element in a first rotational direction and a second rotational direction, opposite the first rotational direction; and a releaser, configured to cancel rotational movement limitation of the second drive element in one or more specified rotation positions of the first drive element, wherein the lock includes a first latch and a second latch, configured to limit the rotational movements of the second drive element, wherein the releaser includes a guide portion of the first drive element, the guide portion having release portions for the latches, wherein the latches contact the guide portion of the first drive element and a guide portion of the second drive element, wherein the guide portion of the second drive element includes a first stop and a second stop for the latches.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
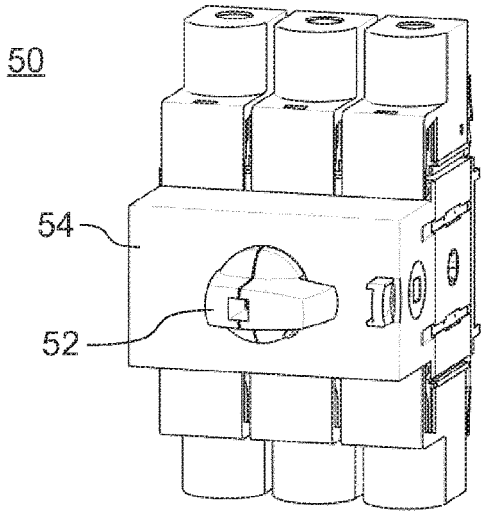
FIG. 1 a perspective external view of an embodiment of a rotary switch comprising an operating apparatus according to the invention.

An aspect of the present invention provides an apparatus for operating a rotary switch which is designed to be simple.

One concept underlying the present invention consists in substantially decoupling, in an apparatus for operating a rotary switch, the speed and the required force for operating the contacts, i.e. opening and closing the contacts, from the speed and the force applied to operate the rotary switch. In other words, the apparatus according to the invention should open or close contacts substantially independently of the force and operating speed applied to operate the rotary switch. To this end, the invention proposes a mechanism in which two drive elements are coupled together by means of a spring, and in which locking and release means are provided which lock or release a rotation of one of the drive elements by the tensioned spring depending on the position of the other drive element. As a result, the movement of the drive element operated by a user can be decoupled from the movement of the other drive element. In other words, the drive element that can be operated by the user is used to release or lock the spring-actuated movement of the other drive element such that the other drive element is moved irrespective of the speed and force applied by the user to operate the first drive element. The invention also proposes the use of latches which contact guide portions of the two drive elements, the guide portion of one of the drive elements having release portions as release means and the guide portion of the other drive element having two stops for the latches as locking means. The latches which contact the guide portions of the two drive elements can both lock and, given appropriate movement of one of the drive elements, also release the spring-operated movement of the other drive element. The apparatus according to the invention has a relatively simple design due to the release and locking means being formed as integral parts of the drive elements and on account of the latches which contact the guide portions of both drive elements, this being particularly advantageous during manufacture.

One embodiment of the invention relates to an apparatus for operating a rotary switch comprising a drive shaft, a first and a second drive element, the first drive element being coupled to the drive shaft in a rotationally fixed manner and the second drive element being mounted on the first drive element in a rotatable manner, a spring which couples the first and the second drive element together in a resilient manner, locking means for limiting the rotational movements of the second drive element in a first direction of rotation and a second direction of rotation which is opposite the first direction of rotation, and release means for canceling the limiting of the rotational movement of the second drive element in specified rotation positions of the first drive element.

According to an aspect of the invention, the locking means comprise a first latch and a second latch for limiting the rotational movements of the second drive element, both latches contacting guide portions of the two drive elements, and the guide portion of the first drive element having release portions for the latches as release means and the guide portion of the second drive element having two stops for the latches as locking means.

The locking and release portions may be provided on the guide portions in such a way that the second drive element is locked for rotation in a first direction of rotation in a first specified rotation position of the first drive element for a first switching state by means of the second latch engaging in a first stop, that the spring is tensioned by rotating the first drive element in the first direction of rotation by a specified angle into a second specified rotation position, the second latch is released by a first of the release portions and the second drive element is rotated in the first direction of rotation into a second switching state by means of the spring force stored in the tensioned spring, that in the second switching state the second drive element is locked for rotation in a second direction of rotation which is opposite the first direction of rotation by means of the first latch engaging in a second stop, and the spring is tensioned by rotating the first drive element in the second direction of rotation by the specified angle, the first latch is released by a second of the release portions after rotating by the specified angle and the second drive element is rotated in the second direction of rotation back into the first switching state by means of the spring force stored in the tensioned spring.

Two release portions may be provided on the first drive element at an angular distance approximately corresponding to the specified angle and a locking portion may be provided on the second drive element, said locking portion comprising the two stops for the first and second latches.

The first and second latches can be arranged such that they can pivot about a common pin above the guide portions and can be pressed onto the guide portions by means of a spring.

The first drive element may comprise a first portion which surrounds the drive shaft at least in part and a second disc-shaped portion which completes the first portion, the second disc-shaped portion having, on the edge thereof, the guide portion comprising the release portions for the latches.

The second drive element may comprise a first portion which surrounds the first portion of the first drive element at least in part and a second disc-shaped portion which completes the first portion, the second disc-shaped portion having, on the edge thereof, the guide portion comprising the two stops for the latches and a gearwheel portion.

The second drive element may be designed as a drive pinion, which can drive a gearwheel coupled to a pin of a rotation contact body.

Other advantages and possible applications of the present invention are explained in the following description in conjunction with the embodiments illustrated in the drawings.

The terms and associated reference numerals used in the list of reference numerals reproduced below are used in the description, claims, abstract and drawings.

Identical components, or components having the same function or associated functions may be assigned the same reference numerals in the description below. Absolute values are only given below by way of example and should not be construed as limiting the invention in any way.

FIG. 1 shows a rotary switch 50, in which the operating apparatus according to the invention is used. In this case, the housing 54 of the switch 50 conceals the operating apparatus. A rotary switch 50 of this kind is installed in a switch cabinet, for example. The switch 50 is provided with a rotary knob 52 for operating the contact element of the rotary switch.

Figure 2:
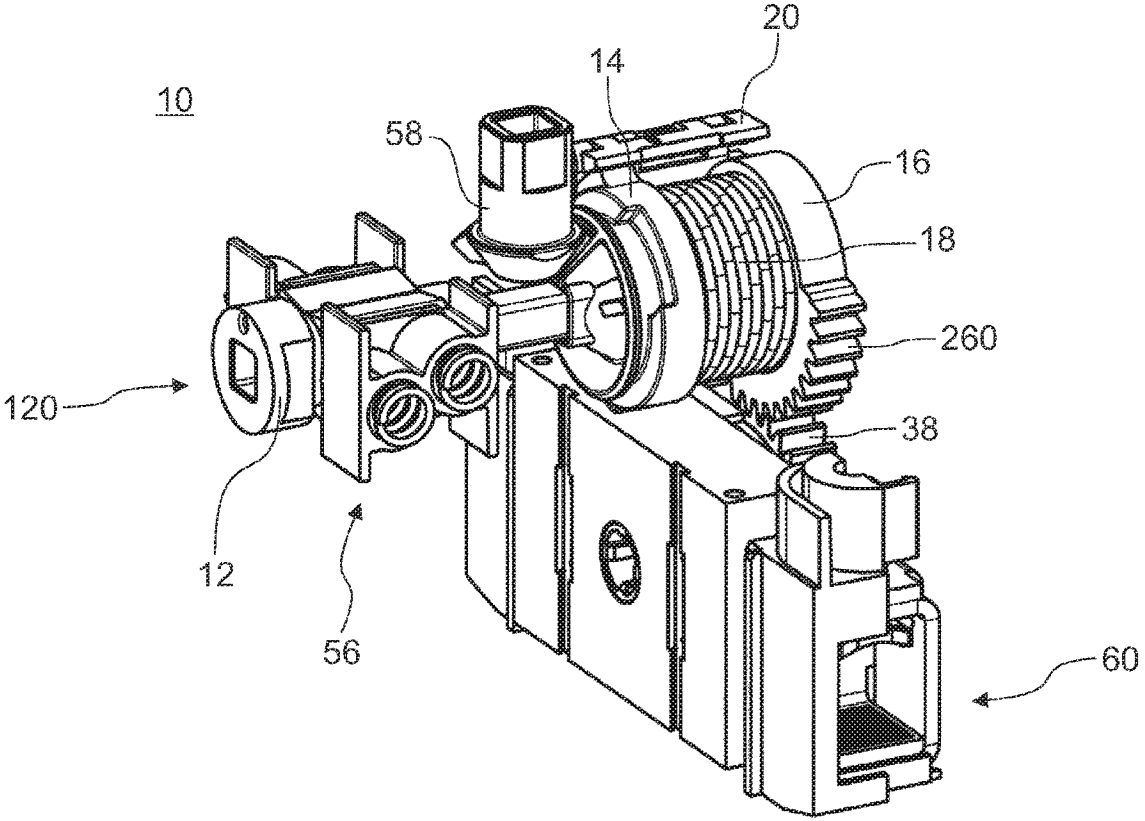
FIG. 2 a perspective view of an embodiment of the operating apparatus according to the invention, as used in the rotary switch illustrated in FIG. 1.

FIG. 2 shows an embodiment of the operating apparatus 10 according to the invention, as it may be used in the switch 50 illustrated in FIG. 1. The apparatus 10 shown comprises a drive shaft 12 having a push-on opening 120 for the rotary knob 52, which knob can be pushed onto the opening 120 in a rotationally fixed manner. Reference numeral 56 refers to a bearing for the drive shaft 12, which may, for example, be installed in a switch cabinet, in particular on the inside of a switch cabinet door. FIG. 2 also shows a bevel gear 58, which is driven by a gearwheel attached in a rotationally fixed manner to the drive shaft 12 when the drive shaft 12 is rotated. In this case, the elements 56 and 58 are not essential parts of the operating apparatus 10.

In addition to the drive shaft 12, the operating apparatus 10 comprises a first drive element 12, a second drive element 16 and a helical spring 18 coupling the two elements 14 and 16, the axis of said spring extending in parallel with the axis of the drive shaft and said spring being rigidly clamped at both ends, one end being rigidly coupled to the first drive element 14 and the other end being rigidly coupled to the second drive element 16.

Figure 4:
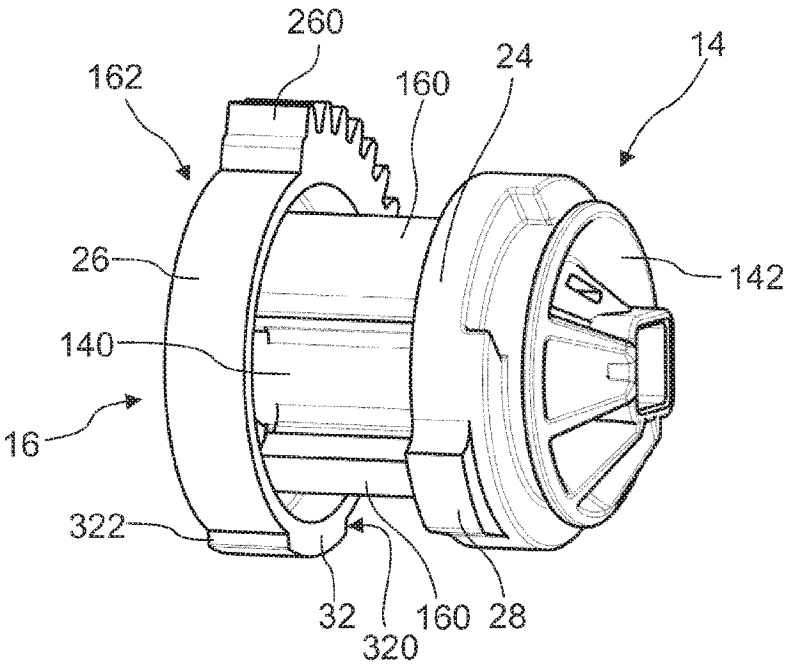
FIG. 4 a further perspective detailed view of the drive of the operating apparatus from FIG. 2.

The first drive element 14 is coupled to the drive shaft 12 in a rotationally fixed manner, and thus rotates with said drive shaft when the drive shaft rotates. The second drive element 16 is mounted on the first drive element 14 in a rotatable manner, specifically pushed over the first drive element 14 as shown in FIG. 4.

A rotational movement of the first drive element 14 is in principle transferred to the second drive element 16 by the spring 18 coupling the two elements. In order to decouple the transmission of this rotational movement and the associated, usually manual rotational movement, caused by the rotary knob, from a rotational movement of the second drive element 16, a first and second latch 20 or 22 (see FIG. 3) are provided, said latches limiting or locking the rotational movement of the second drive element 16. To this end, the latches 20 and 22 can be pivoted about a common pin 40 and are pressed onto guide portions 24 and 26 of the two drive elements 14 or 16 by means of a spring 42 arranged on the pin 40.

The guide portion 24 of the first drive element 14 has two release portions 28, 30 as release means for the latches 20, 22. The release portions 28, 30 are designed such that they raise the latches 20, 22 radially to such an extent that they no longer lock or block a rotational movement of the second drive element 16. In this case, the release portions 28 and 30 are formed such that they raise one or both latches 20, 22 depending on the rotation position of the first drive element 14.

The guide portion 26 of the second drive element 16 comprises a locking portion 32, which forms two stops 320 and 322 for the latches 20 and 22. As soon as a latch 20, 22 engages in one of the stops 320, 322 and is not radially raised by a release portion 28, 30 of the first drive element, a rotational movement of the second drive element 16 in a first or a second direction of rotation 34 or 36 which is opposite the first direction of rotation is locked.

Figure 3:
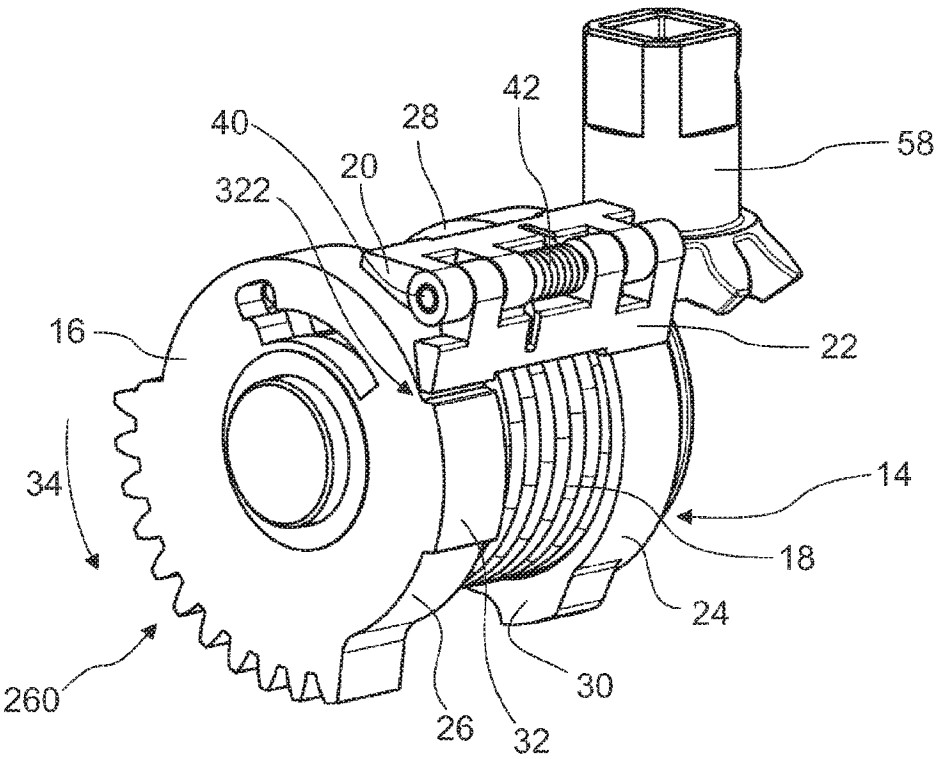
FIG. 3 a perspective detailed view of the drive of the operating apparatus from FIG. 2.

FIG. 3 shows parts of the operating apparatus 10 in a first switching state in which the contact element of the switching device is, for example, brought by the operating apparatus into a position in which the contacts of the switching device are opened. In the first switching state, the second latch 22 engages in a latch stop 322 of the locking portion 32 on the guide portion 26 of the second drive element 16 and locks a rotational movement of this element in a first direction of rotation 34 in order to reach a second switching state. If the drive shaft 12 and the first drive element 14 connected to said drive shaft in a rotationally fixed manner are rotated in the first direction of rotation 34 by a specified angle of approximately 120° for example, the spring 18 is tensioned as a result of the rotation and on reaching the position corresponding to the second switching state by means of the first drive element 14, the second latch 22 is radially raised by the release portion 30 of the guide portion 24 of the first drive element 14, as a result of which the lock on rotational movement by the second drive element 16 is canceled and the spring force stored in the tensioned spring 18 causes a rotation of the second drive element 16 in the first direction of rotation. This rotation causes the gearwheel 38 (FIG. 2) to be rotated by means of the gearwheel portion 260, causing the contact element to be brought into a position in which the contacts of the rotary switch are closed, for example.

In this second switching state, the latch 20 engages in a latch stop 320 of the locking portion 32 on the guide portion 26 of the second drive element 16, and locks a rotational movement of this element in a second direction of rotation 36, which is opposite the first direction of rotation 34, such that the second drive element 16 is prevented from being rotated back to the first switching state. If the drive shaft 12 and the first drive element 14 connected to said drive shaft in a rotationally fixed manner are rotated in the second direction of rotation 36 by a specified angle of approximately 120° for example, the spring 18 is again tensioned as a result of the rotation and on reaching the position corresponding to the first switching state by means of the first drive element 14, the first latch 20 is radially raised by the release portion 28 of the guide portion 24 of the first drive element 14, as a result of which the lock on rotational movement by the second drive element 16 is canceled and the spring force stored in the tensioned spring 18 causes a rotation of the second drive element 16 in the second direction of rotation. This rotation causes the gearwheel 38 (FIG. 2) to be rotated by means of the gearwheel portion 260, causing the contact element to be brought into a position in which the contacts of the rotary switch are open.

FIG. 4 shows an embodiment of the two drive elements 14 and 16 in the installed state: the first drive element 14 comprises a first portion 140, by means of which said first drive element can be mounted on the drive shaft in a rotationally fixed manner. A second portion 142 of the element 14 completes the first portion 140 and is designed such that it is disc-shaped. This portion 142 has, on the edge thereof, the guide portion 24 comprising the two release portions 28 and 30 for the latches. A first portion 160 of the second drive element 16 is mounted on the first portion 140 of the first element 14 in a rotatable manner, and in particular pushed over this portion. The first portion 160 is completed by a disc-shaped portion 162, the edge of said portion comprising the guide portion 26 comprising the locking portion 32 for the latches and a gearwheel portion 260 for moving a gearwheel for the contact element of the rotary switch.

Figure 5:
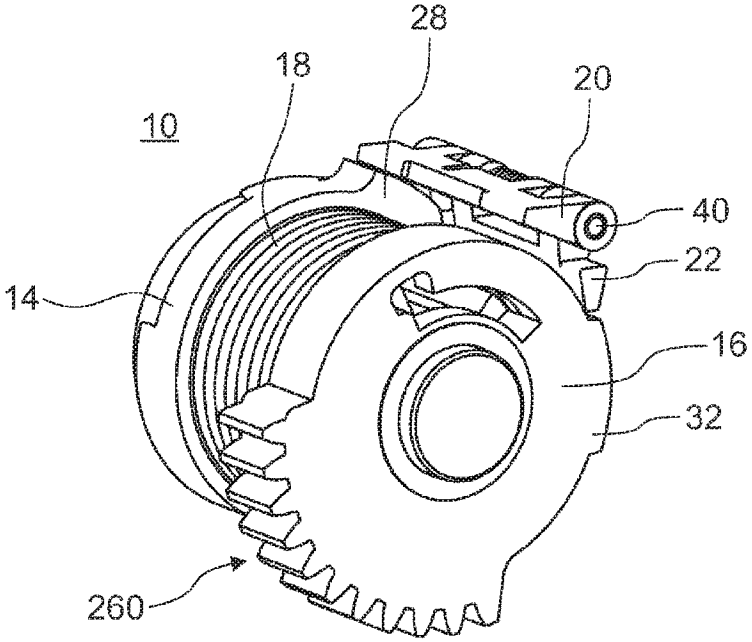
FIG. 5 a further perspective detailed view of the drive of the operating apparatus from FIG. 2.
Figure 6:
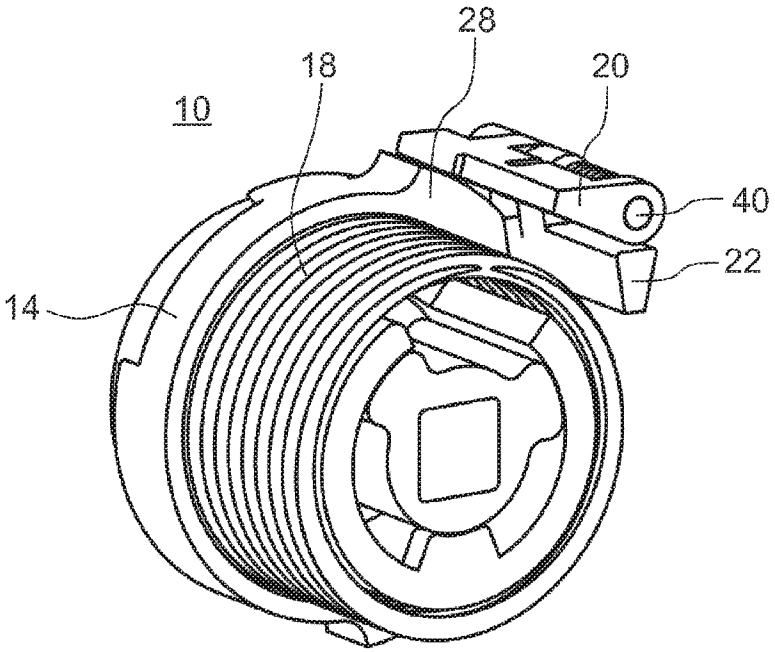
FIG. 6 a perspective detailed view of FIG. 5, in which a drive pinion has been removed.
Figure 7:
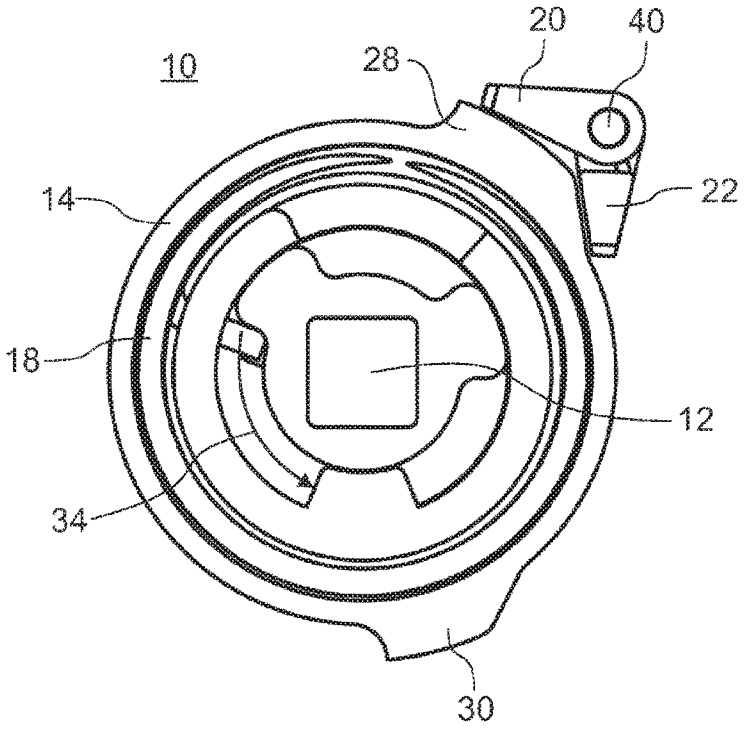
FIG. 7 a plan view of the drive illustrated in FIG. 6 during free-wheeling.
Figure 8:
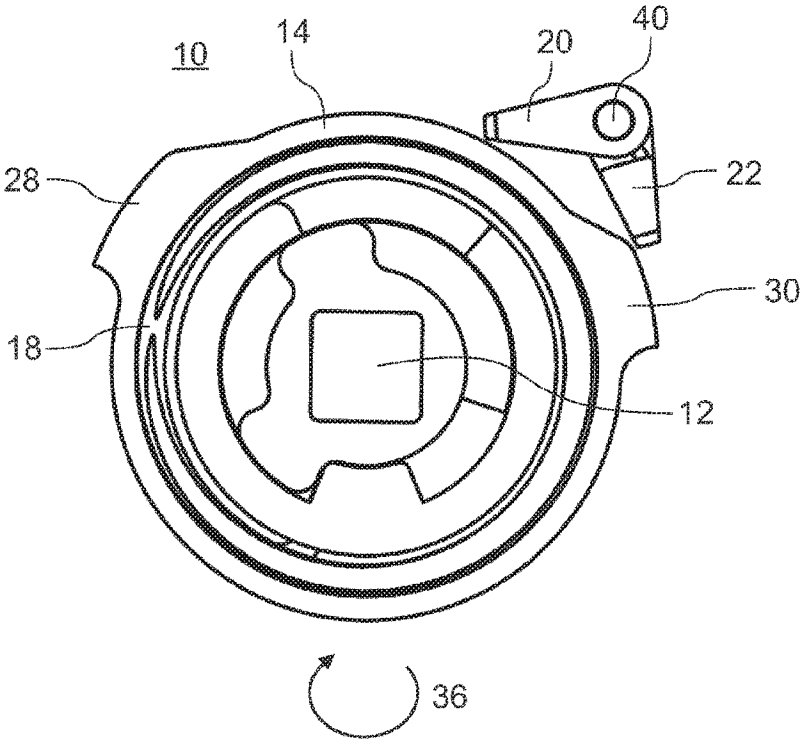
FIG. 8 a further plan view of the drive illustrated in FIG. 6 at the stop when the rotary switch contacts are closed.

FIG. 5 is a further view of the operating apparatus 10 and FIG. 6 is a view in which the second drive element 16 has been removed. FIGS. 7 and 8 are plan views of the operating apparatus 10, the second drive element 16 having been removed: FIG. 7 shows a free-wheeling position in which the first latch 20 is radially raised by the release portion 28 and thus can no longer lock rotation of the second drive element 16 in the second direction of rotation 36. However, the second latch 22 is not raised and is able to lock rotation of the second drive element 16 in the first direction of rotation 34. FIG. 8 shows a position in which the second latch 22 is radially raised by the release portion 30 and is thus unable to lock rotation of the second drive element 16 in the first direction of rotation 34, while the first latch 20 is not radially raised and is able to lock rotation of the second drive element 16 in the second direction of rotation 36. In the state illustrated in FIG. 8, the first drive element 14 is located at the stop (positive connection) and can therefore not be rotated any further in the first direction of rotation 34.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

REFERENCE NUMERALS

10 rotary switch operating apparatus
12 drive shaft
120 rotary knob push-on opening
14 first drive element
140 first portion of the second drive element 14

142 second portion of the second drive element 14
16 second drive element
160 first portion of the second drive element 16
162 second portion of the second drive element 16
18 spring
20 first latch
22 second latch
24 guide portion
26 guide portion
260 gearwheel portion
28 release portion
30 release portion
32 locking portion
320 latch stop
322 latch stop
34 first direction of rotation
36 second direction of rotation
38 gearwheel
40 latch pivot pin
42 spring
50 rotary switch
52 rotary knob
54 switch housing
56 drive shaft bearing
58 gear
60 contact element for the rotary switch 50

The invention claimed is:

1. An apparatus for operating a rotary switch, the apparatus comprising:

a drive shaft;

a first drive element, coupled to the drive shaft in a rotationally fixed manner;

a second drive element, mounted on the first drive element in a rotatable manner;

a spring which couples the first and the second drive elements together in a resilient manner;

a lock, configured to limit one or more rotational movements of the second drive element in a first rotational direction and a second rotational direction, opposite the first rotational direction; and a releaser, configured to cancel rotational movement limitation of the second drive element in one or more specified rotation positions of the first drive element, wherein the lock includes a first latch and a second latch, configured to limit the rotational movements of the second drive element, wherein the releaser includes a first guide portion of the first drive element, the first guide portion having release portions for the latches, wherein the latches contact the first guide portion of the first drive element and a second guide portion of the second drive element, wherein the second guide portion of the second drive element includes a first stop and a second stop for the latches.

2. The apparatus of claim 1, wherein the lock and the release portions are provided on the first and second guide portions in such a way that, in a first specified rotation position of the first drive element, for a first switching state, the second drive element is locked for rotation in the first rotational direction using the second latch to engage in a first stop, wherein, by rotating the first drive element in the first rotational direction by a specified angle into a second specified rotation position, the spring is tensioned, the second latch is released by a first of the release portions, and the second drive element is rotated in the first rotational direction into a second switching state using the spring force stored in the tensioned spring, wherein, in the second switching state, the second drive element is locked for rotation in the second rotational direction, opposite the first rotational direction, using the first latch to engage in a second stop, and wherein, by rotating the first drive element in the second rotational direction by the specified angle, the spring is tensioned, the first latch is released by a second of the release portions after rotating by the specified angle and the second drive element is rotated in the second rotational direction back into the first switching state using the spring force stored in the tensioned spring.

3. The apparatus of claim 1, wherein the release portions comprise a first release portion and a second release portion on the first drive element at an angular distance approximately corresponding to the specified angle, wherein a locking portion is provided on the second drive element, and wherein the locking portion includes the first and second stops for the first and second latches.

4. The apparatus of claim 1, wherein the first and second latches are arranged such that they can pivot about a common pin above the first and second guide portions and are pressed onto the first and second guide portions using a spring.

5. The apparatus of claim 1, wherein the first drive element includes a first surrounding portion, which surrounds the drive shaft at least in part, and a second disc-shaped portion, which completes the first portion, wherein the second disc-shaped portion includes, on an edge thereof, the first guide portion including the release portions for the latches.

6. The apparatus of claim 5, wherein the second drive element includes a first surrounding portion, which surrounds the first portion of the first drive element at least in part, and a second disc-shaped portion, which completes the first surrounding portion, wherein the second disc-shaped portion includes, on an edge thereof, the second guide portion including the two stops for the latches and a gearwheel portion.

7. The apparatus of claim 1, wherein the second drive element is configured as a drive pinion, wherein the drive pinion can drive a gearwheel coupled to a pin of a rotation contact body.

* * * * *